US008490629B1

(12) United States Patent
Shenassa et al.

(10) Patent No.: US 8,490,629 B1
(45) Date of Patent: Jul. 23, 2013

(54) THERAPEUTIC SMOKING DEVICE

(75) Inventors: Mitchel B. Shenassa, Longmont, CO (US); Michael A. Sulka, Boulder, CO (US); Michael F. Cupo, Boulder, CO (US); George P. O'Connor, Golden, CO (US)

(73) Assignee: Incredibowl Industries, LLC, Boulder, CO (US)

( * ) Notice: Subject to any disclaimer, the term of this patent is extended or adjusted under 35 U.S.C. 154(b) by 302 days.

(21) Appl. No.: 12/871,455

(22) Filed: Aug. 30, 2010

Related U.S. Application Data

(60) Provisional application No. 61/238,444, filed on Aug. 31, 2009.

(51) Int. Cl.
*A24F 5/04* (2006.01)

(52) U.S. Cl.
USPC ..... 131/198.2; 131/198.1; 131/194

(58) Field of Classification Search
USPC ..... 131/173, 200, 329, 330, 194, 198.1, 131/198.2; 128/203.12
See application file for complete search history.

(56) References Cited

U.S. PATENT DOCUMENTS

| | | | | |
|---|---|---|---|---|
| 2,686,524 | A * | 8/1954 | Kershaw, Sr. et al. | 131/211 |
| 4,044,781 | A * | 8/1977 | Heggestuen | 131/173 |
| 246,604 | A | 12/1977 | Frost | |
| 4,253,475 | A * | 3/1981 | Schreiber et al. | 131/173 |

* cited by examiner

*Primary Examiner* — Richard Crispino
*Assistant Examiner* — Yana Belyaev
(74) *Attorney, Agent, or Firm* — Patent Law Offices of Rick Martin, P.C.

(57) ABSTRACT

A smoking device intended for therapeutic uses, such as medical marijuana or herbal remedies, providing for cooling of smoke due to latency in multiple chambers, filtration of condensed tars from cooled smoke, and decreased respiratory strain for the user provided by a annular carburetor valve, which propels the cooled and filtered smoke into the user's airstream by means of pressure equalization. In a preferred embodiment, the device is constructed so as to be extremely durable, shielding the glass smoking bowl from impact and shock, and is manufactured of non-toxic materials appropriate to a device for therapeutic use. A venturi effect chasing of entrapped smoke projects the smoke quickly into the lungs. The taste of different herbs such as tobacco, *cannabis indica, cannabis sativa* and different strains of each is accentuated.

16 Claims, 14 Drawing Sheets

Annular Purge Carburator (APC) Closed

Annular Purge Carburator (APC) Open

THERAPEUTIC SMOKING DEVICE

CROSS REFERENCE APPLICATIONS

This application is a non-provisional application claiming the benefits of provisional application No. 61/238,444 filed Aug. 31, 2009.

FIELD OF INVENTION

The present invention relates to smoking a smoking material such as medical marijuana through a filter system and moveable carburetor valve in order to minimize bronchial irritation.

BACKGROUND OF THE INVENTION

In the smoking of organic materials including some rare and expensive tobaccos, it is found that inhaled smoke oftentimes tends to be somewhat harsh, hot and irritating to the lungs of a smoker. Accordingly, it is desirable that the smoke from these materials be tempered and treated prior to its being inhaled. Devices known as "water pipes" and "bongs" have been used to effect tempering and treatment of smoke.

A water pipe ordinarily includes an upstanding housing which defines a water chamber near its base. A burning bowl is operably connected to the housing for introducing smoke into the water chamber. A mouthpiece communicates with the water chamber for drawing smoke from the burning bowl through the water chamber. As the smoke travels through the water, it tends to be cleaned of ash and certain other contaminants, and may be cooled slightly to render it more suitable for inhaling. In some instances, liquids other than water have been used in the water chamber. The use of wine has been proposed as a suitable water substitute.

A bong is ordinarily quite similar in construction to a water pipe, the principal difference being that the bong has no mouthpiece communicating with its water chamber but rather utilizes a housing pressed against facial portions around the mouth of a smoker. As the smoker inhales, smoke from a burning bowl is drawn through water or other liquid disposed in a chamber at the lower end of the housing. A small diameter air admission hole may be formed through the wall of the housing at a level above that of the liquid. This hole may be maintained closed by a simple flap valve or may be held closed by the smoker during initial stages of a draw, where upon the smoker may open the air admission hole toward the end of a draw to ease the draw as smoke from the chamber is inhaled.

While the adverse effects of harsh, hot and irritating smoke may be mitigated to a degree by proposed water pipe and bong appliances, the tempering and treating action they provide is not as thorough as many smokers desire. One reason for the relatively ineffective tempering and treating action provided by such appliances is that smoke being drawn through a liquid medium tends to travel through the medium in the form of a stream of rapidly moving bubbles. Only the outer surface areas of the rapidly moving bubbles are exposed to the liquid medium and the exposure time is quite minimal. While proposals have been made to increase exposure time by providing a relatively deep body of liquid filtering medium and/or by providing structure which defines relatively torturous paths for movement of smoke through the liquid medium, these proposals have been found to be relatively ineffective in improving the filtering and cooling actions and, in most instances, have significantly increased the draw strength required to effect the passage of smoke through the cooling medium. Many proposed water pipe and bong appliances require unduly large draw strengths to effect proper operation.

A further disadvantage of many water pipe and bong appliance proposals has been that the liquid utilized as a cooling and filtering medium tends to become contaminated with ash particles within a relatively short period of time and must therefore be changed frequently. While proposals have been made to provide various types of ash collection chambers at locations which will prevent the entry of ash particles into the liquid cooling and filtering medium, most of these proposals have significantly increased the complexity, and hence the cost, of the resulting smoking appliances. Moreover, in many instances, these proposals have propounded the excessive draw strength problem and have rendered the appliances more difficult to clean.

U.S. Pat. No. 4,164,950 (1979) to Bechtold uses a cooling chamber and a solid phase multi-bore cooling medium to temper and treat the smoke. Ice is the preferred cooling medium. The disadvantage here is the complexity, cost and lack of portability of the device. Ice is not always available.

The problem of providing a relatively simple and inexpensive smoking appliance which will provide a desirably effective filtering action, which will require minimal draw strength to operate, and yet which is easy to clean has continued to elude those skilled in the art.

The present invention overcomes the foregoing and other drawbacks of the prior art by providing a novel and improved, simple and inexpensive, easy to clean smoking appliance which employs a solid-phase filter medium to effect a thorough filtering of smoke while requiring minimal draw strength to operate due to a manually operated carburetor.

SUMMARY OF THE INVENTION

The primary aspect of the present invention is to provide a portable, filtering, and minimally irritating pipe for smoking plant matter, such as therapeutic or medicinal herbs.

Another aspect of the present invention is to provide a manually operated carburetor valve for easy inhalation control.

Another aspect of the present invention is to provide an easy to disassemble and clean apparatus.

A smoke expansion chamber is preferably a cylindrical, plastic tube. The bowl-end allows combustion of the smoking matter. The bowl-end has a manually held annular valve head which is pulled open, overcoming a spring bias. In the open position, trapped smoke is mixed with admitted air to provide a non-irritating, filtered smoke. This smoke is projected into the user's airstream without the traditional unduly large draw by means of exerting respiratory effort.

Features of the invention include:

Tulip shape of glass bowl to help prevent smoking material from falling out.

Shock mounting for glass on internal bushings.

Aluminum valve-head protects glass from impact.

Annular purge carburetor allows for rapid clearing without requiring the user exert respiratory effort.

Filtration screen is held away from direct flame or heat, allowing it to catch more resin and tar, as they have condensed during cooling.

Injection nozzle can be crafted to utilize Venturi shape for smoother expansion into the expansion chamber.

Smooth laminar flow through screen into visible expansion chamber.

Expansion chamber is shatterproof and permanently marked.

Expansion chamber is sized for user comfort and can easily be swapped for a chamber of a preferable size.

Visible expansion chamber allows user to see and control dosage.

Expansion chamber can hold additional instrumentation, such as dosage or temperature measurement devices.

Expansion chamber can hold additional aesthetic features, such as lighting.

Mouthpiece is formed into the end of the expansion chamber for user comfort.

Device is ruggedized, but still employs a borosilicate glass bowl to avoid contamination of smoke.

Unitized, standardized manufacture techniques allow for the repeatability and uniformity of parts, allowing for easy part replacement.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
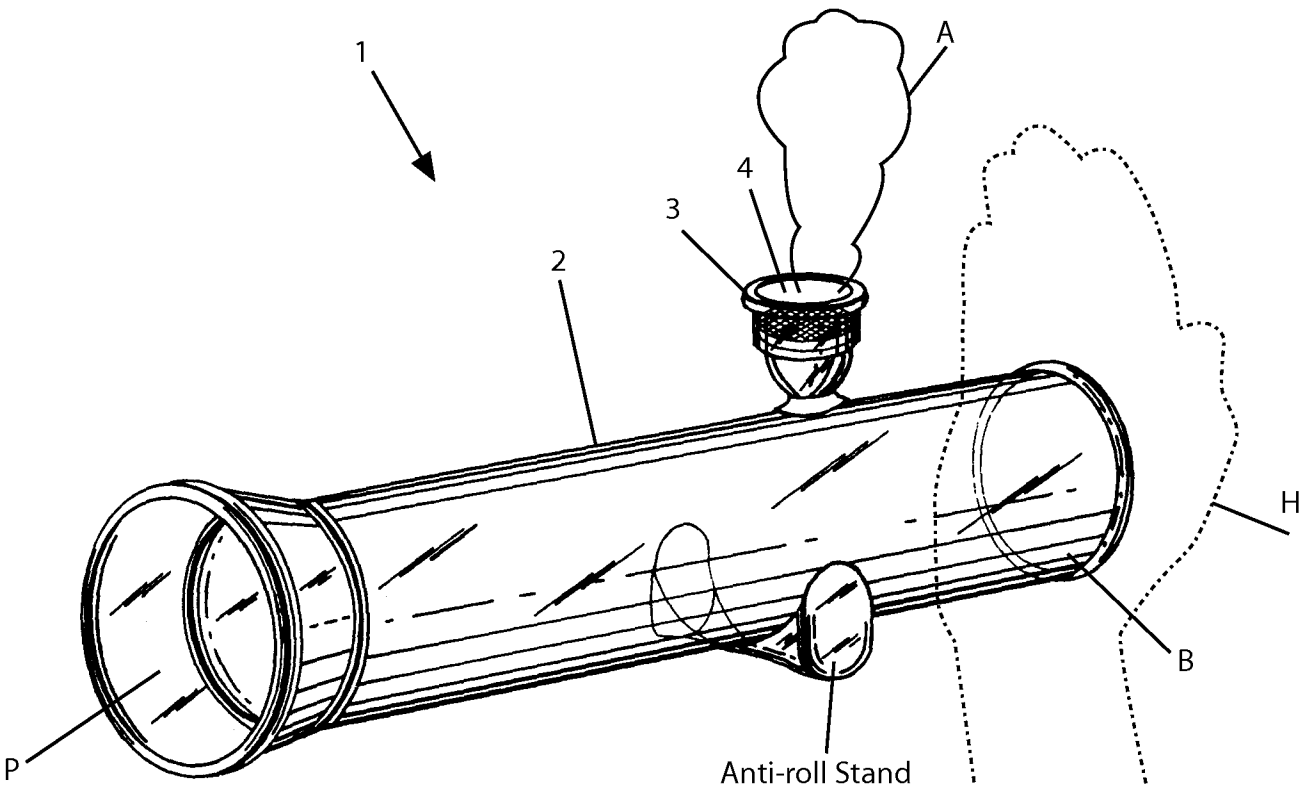
Fig 1 (Prior Art)
FIG. 1 (prior art) is a perspective view of a basic expansion chamber style smoking pipe.

In FIG. 1 a prior art smoking pipe 1 has an expansion chamber 2 with a smoking bowl 3. When smoking material 4 is burning, the smoke A generally rises away from the expansion chamber 2. For inhalation, the hand H of the user is placed over the air admission hole B. Then the user uses his mouth to suck from inhalation exhaust port P. Thus, the smoke A is drawn into the expansion chamber 2. The user then removes his hand H from the air admission hole B while inhaling, thereby projecting a rush of smoke into the user's mouth. Limited cooling and no filtration of the inhaled smoke occurs.

Figure 2:
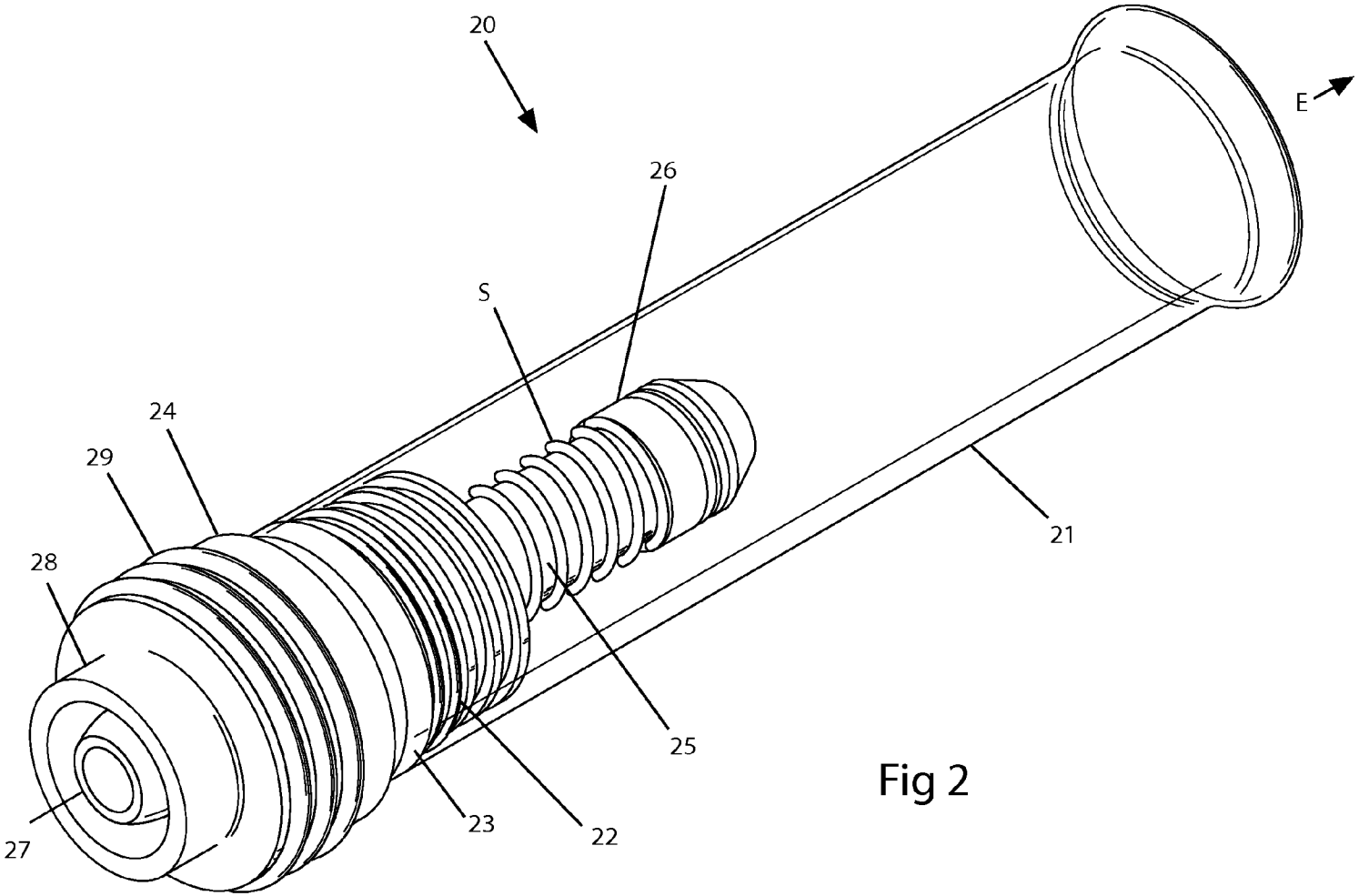
FIG. 2 is a perspective view of the present invention with the spring biased closed annular purge carburetor (APC).

Referring next to FIG. 2 a pipe 20 has a smoke expansion chamber 21 nominally made from a polycarbonate plastic. It is suited to be laser embossed with decorative designs, and/or text. The smoke expansion chamber 21 slides over the bushings 22 which fit around the annular purge carburetor (APC) 23.

The valve head 24 supports a smoke injection shaft 25 having a smoke injection nozzle 26. The glass bowl 27 slides into the neck 28 of the valve head 24. Grip rings 29 provide a strong grip surface to allow easy pulling of the valve head 24 away from the APC 23 during inhalation.

Figure 3:
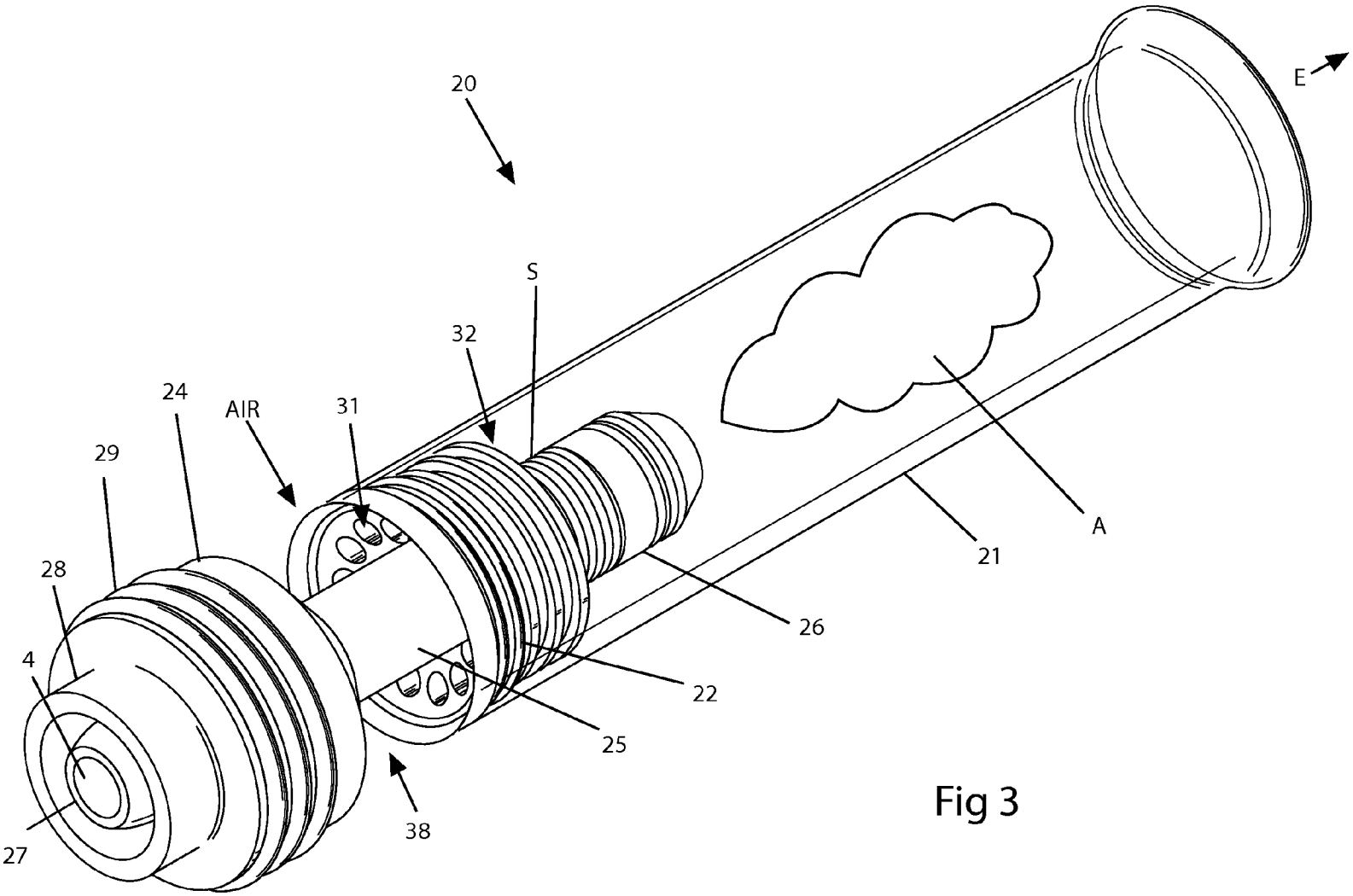
FIG. 3 is the same view as FIG. 2 with the APC held open.

In FIG. 3 the spring S has been overpowered by the user pulling the valve head 24 open. Spring S is seated on nozzle 26. Air enters annular inlet 38, then the air flows through bore entrances 31 and out bore exits 32 and into expansion chamber 21, where it pushes smoke A, and exits port E, into the user's mouth.

Figure 4:
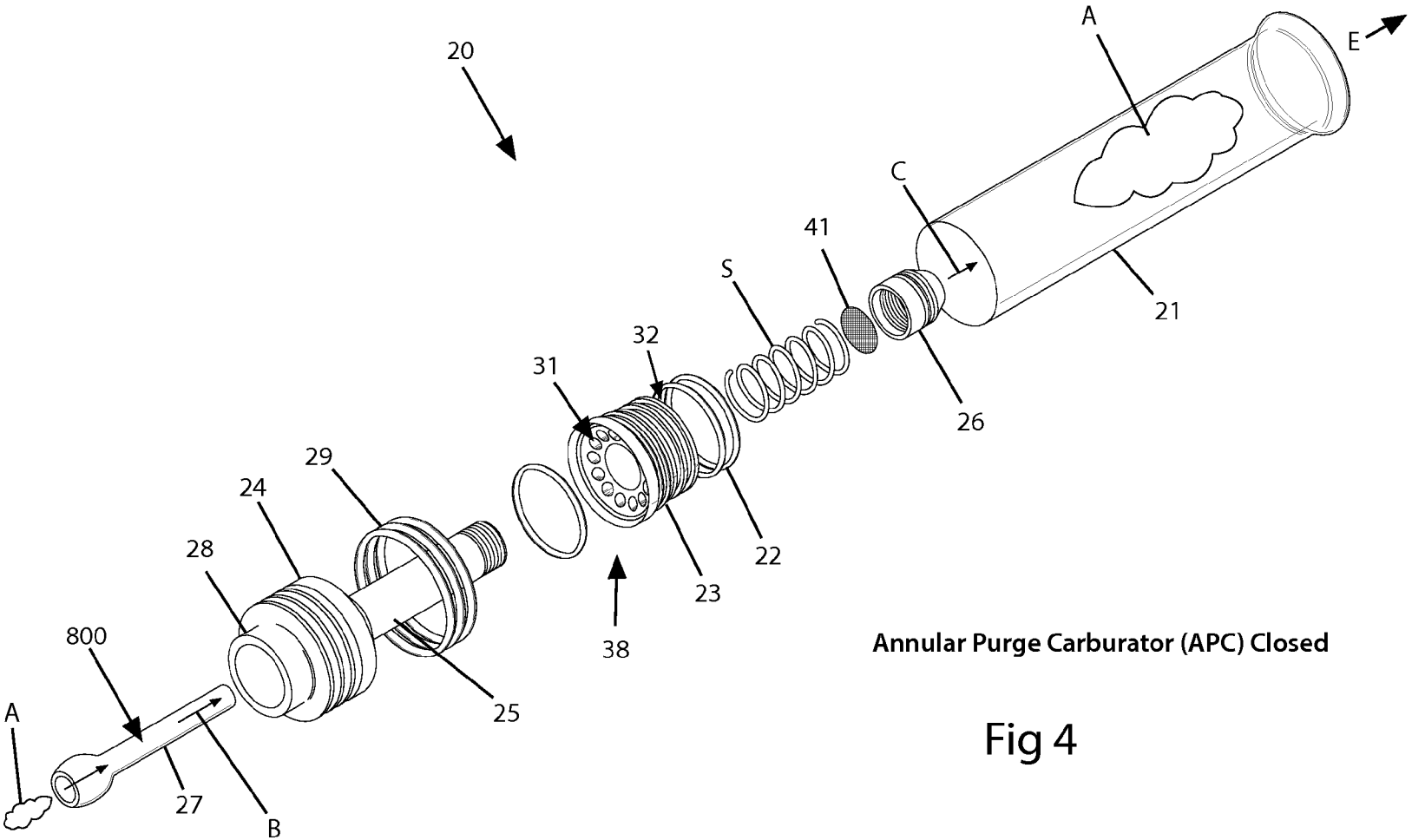
FIG. 4 is an exploded view of the present invention with the smoke path shown in the APC closed position.

In FIG. 4 the smoke path for smoke A is shown for the APC 23 closed mode. Smoke A travels down glass bowl 27 which is inside smoke injection shaft 25, see arrow B. Smoke exits nozzle 26 at arrow C after being filtered by stainless steel screen 41. Suction caused by the user's mouth and inhalation pressure causes this smoke A path from B to C. Very little smoke A is inhaled in this mode because the inside passage 800 of glass bowl 27 is small (nominally 4 mm), and the smoking material is plugging this narrow passage.

For inhalation the user pulls the valve head 24 away from himself, thereby opening annular passage 38. Inhalation air which is at ambient temperature enters passage 38, flows through bore entrances 31, out bore exits 32, and into expansion chamber 21, and inhaled. A projection of inhalation air is caused by the user's suction. The force of the inhalation air against smoke A reduces the draw strength required to convey the smoke to the user's lungs. Cooling of smoke A occurs during the latency periods in the shaft 25, nozzle 26, screen 41, and the expansion chamber 21 before the user pulls the valve head 24. Further cooling occurs with the introduction of the ambient air which acts as a chaser of the smoke into the user's lungs.

Figure 5:
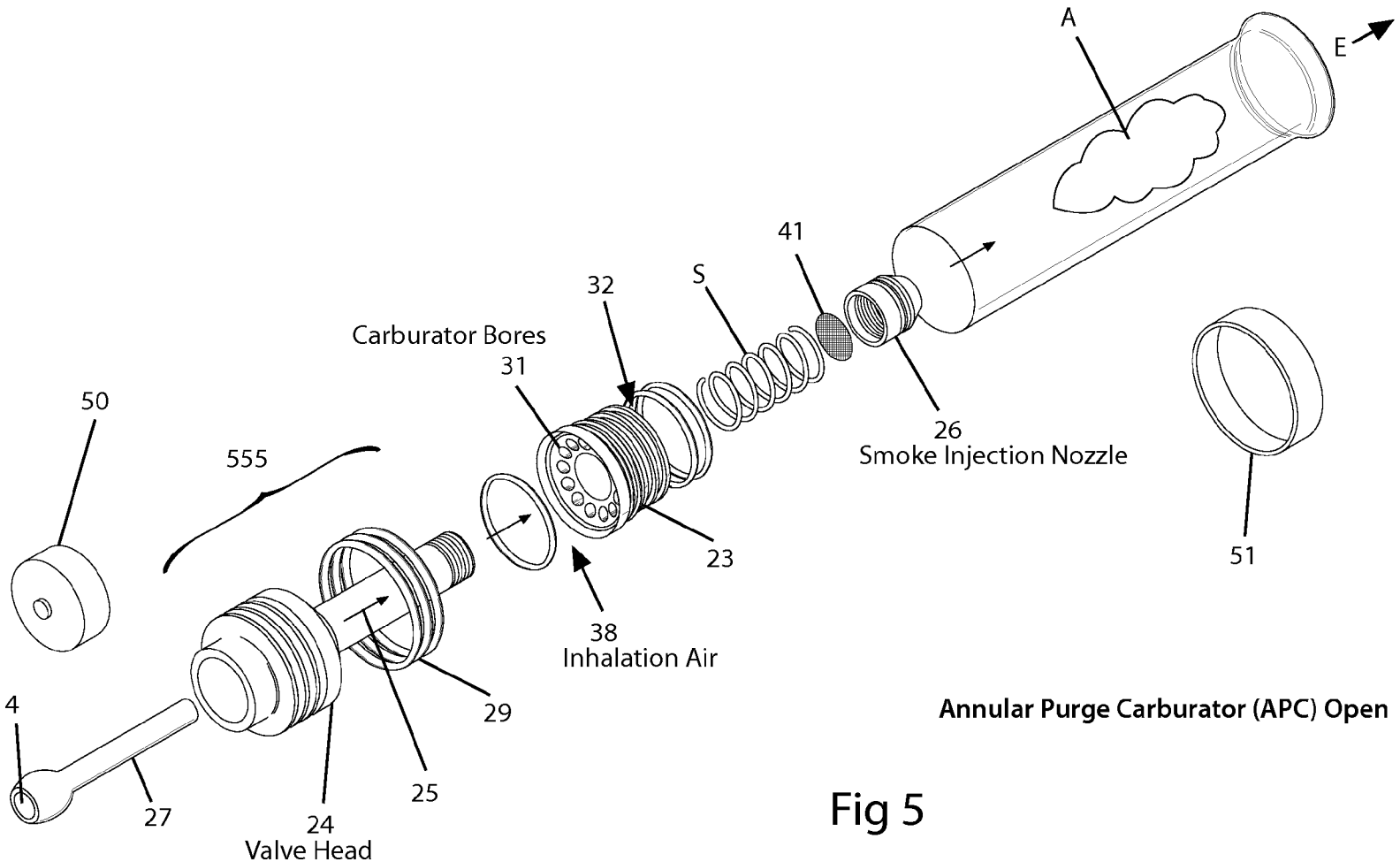
FIG. 5 is an exploded view of the present invention with the smoke path shown in the APC open position.

In FIG. 5 valve head cap 50 and expansion chamber cap 51 are optional. Burn assembly 555 includes valve head 24, glass bowl 27, APC 23 smoke injection shaft 25 and smoke injection nozzle 26 which has filter screen 41 inside.

Figure 6:
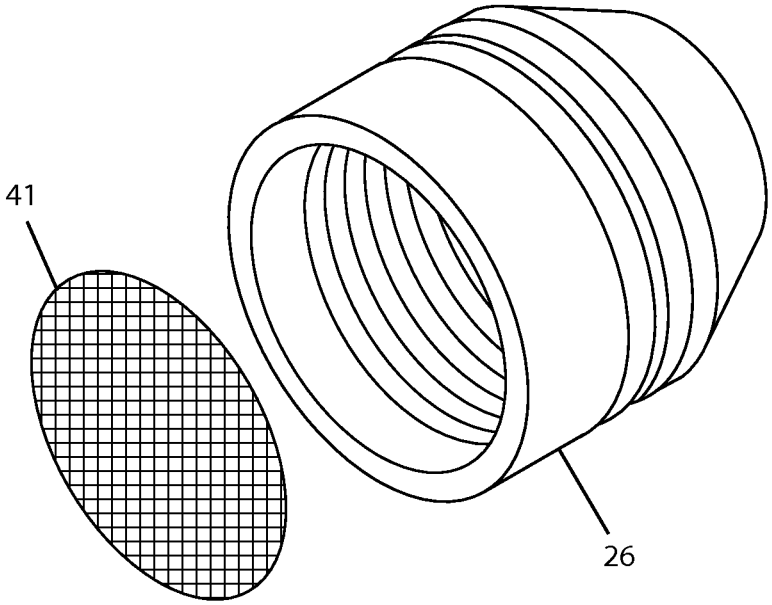
FIG. 6 is a perspective view of the filter assembly.

FIG. 6 shows the nozzle 26 (preferably aluminum) having filter screen 41 which may be allowed to soak in a solvent to remove tars and/or replaced. The filter pipe screen 4' is preferably a stainless steel 316 with hole sizes of 100 mesh.

Figure 7:
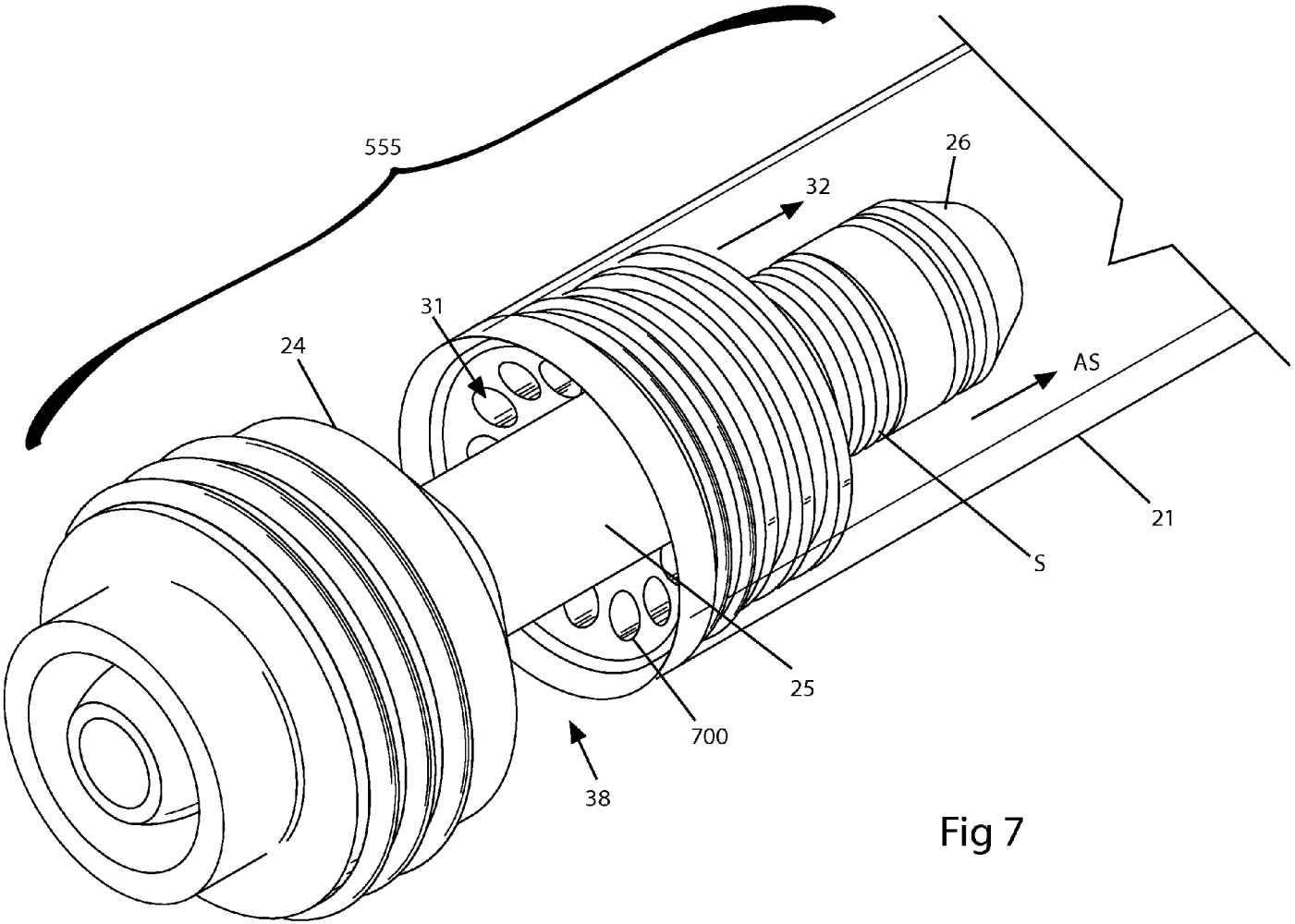
FIG. 7 is a close-up view of the inlet to the APC.

In FIG. 7 each bore hole is labeled 700, each having inlet 31 and outlet 32. The plastic expansion chamber 21 is preferably transparent and slides on and off bushings 22 for cleaning. The nozzle 26 unscrews from shaft 25 for cleaning. In operation the bore holes 700 create a plurality of parallel air streams AS out the outlets 32. The combined effect of these air columns produces a venturi effect which accelerates the air speed of these columns of air streams AS. This venturi effect creates a chaser effect like a plunger rapidly forcing the (cooled) smoke into the user's lungs.

Figure 8:
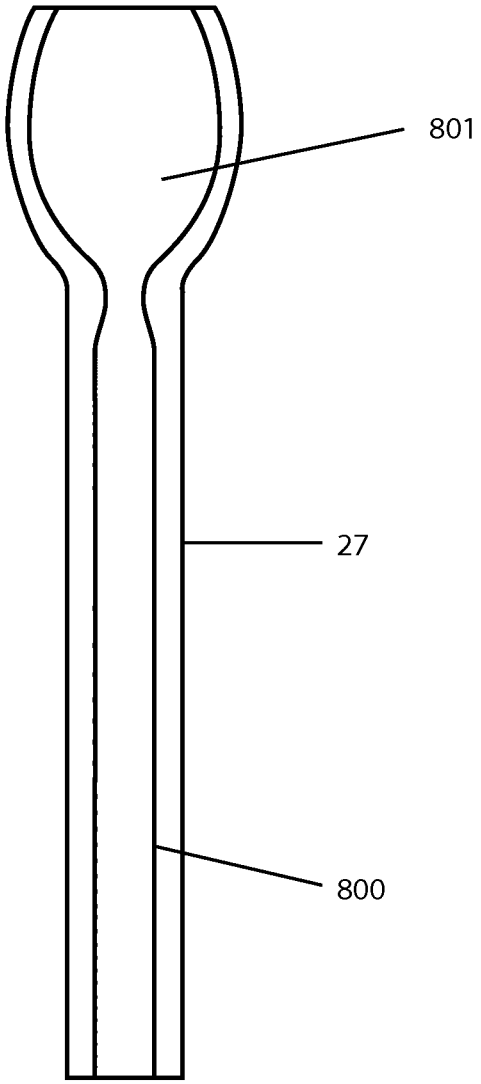
FIG. 8 is a front elevation view of the glass bowl.

FIG. 8 shows glass bowl 27 having a burn chamber 801 and inside passage 800 with about a 4 millimeter diameter.

Figure 9:
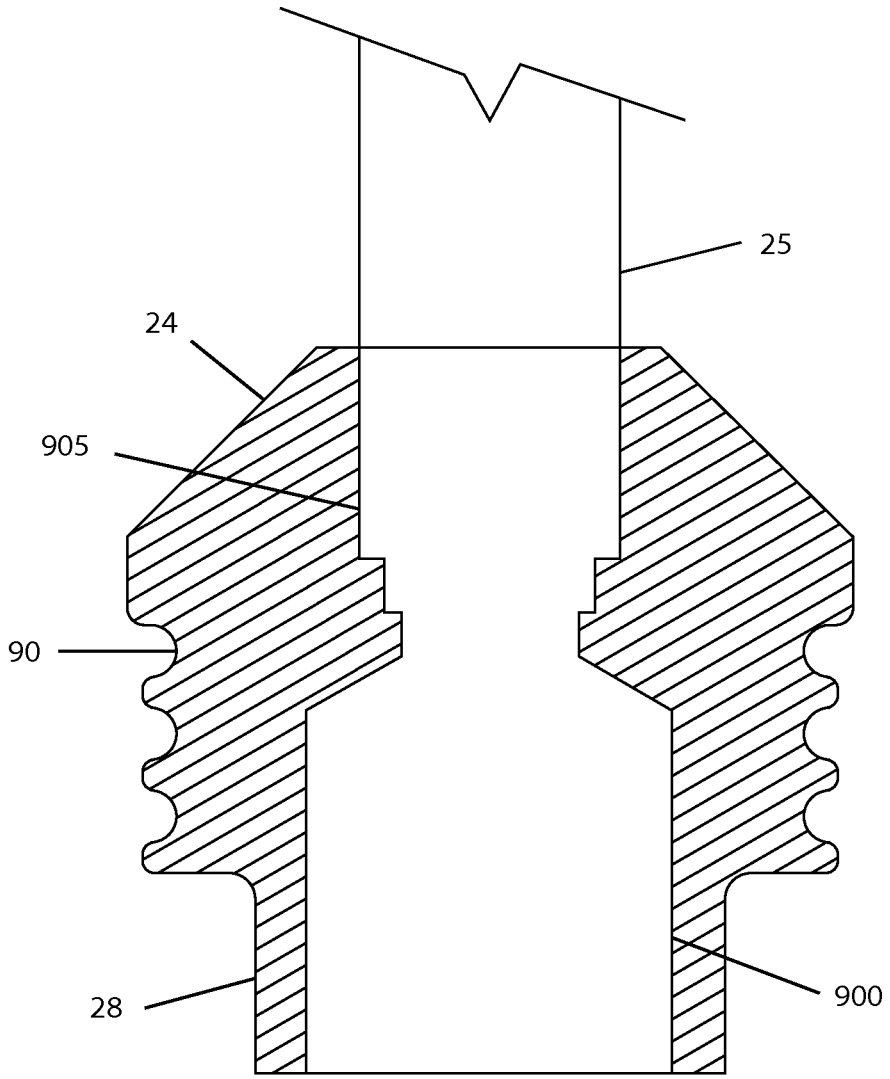
FIG. 9 is a longitudinal cross sectional view of the valve head.

FIG. 9 shows valve head 24 having an inside channel 900 with a diameter of about 0.875 inches. Grooves 90 support grip rings 29. Shaft 25 is preferably press fit into a female bore 905 into valve head 24. Threads, circlips and similar connecting methods may serve the similar purpose of holding the parts together in other embodiments of the invention. Another embodiment is making the valve head 24 and the shaft 25 out of one piece of material.

Figure 10:
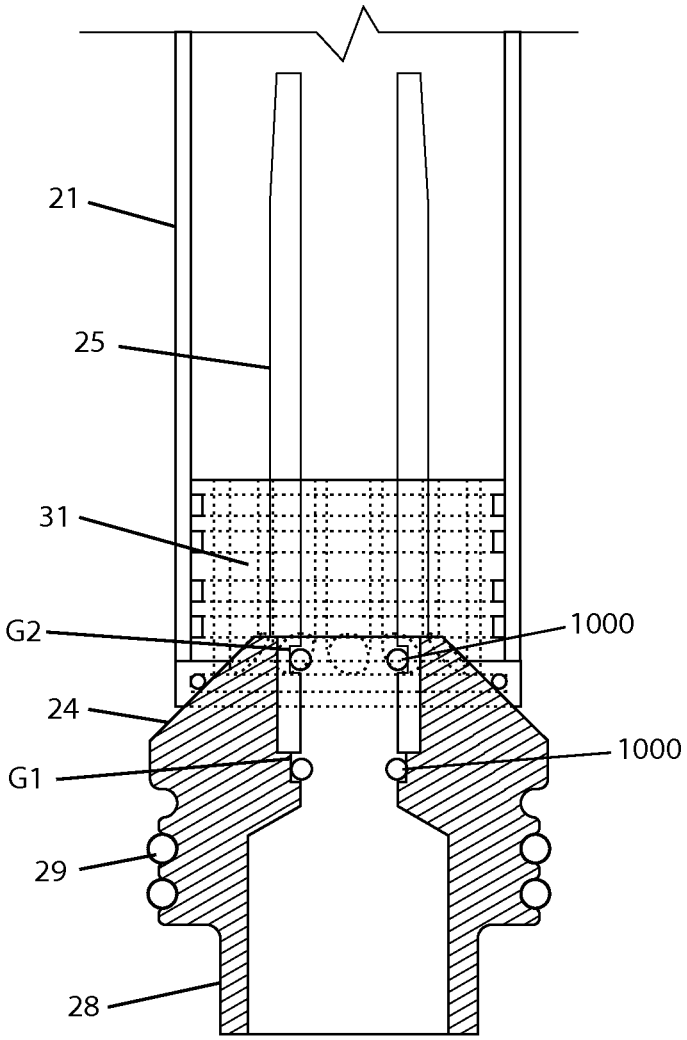
FIG. 10 is a longitudinal cross-sectional view of the valve head, the APC, the smoke injection shaft and a portion of the expansion chamber.

FIG. 10 shows how bushings 1000 hold the glass bowl 27. Grooves G1, G2 support the bushings 1000.

Figure 11:
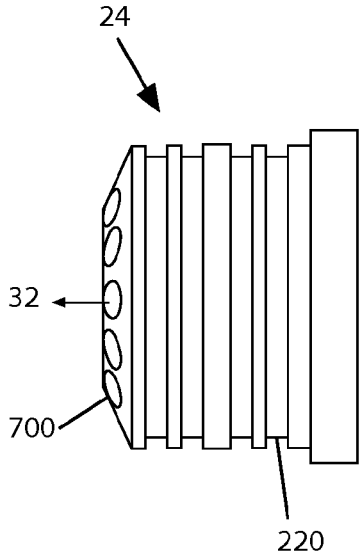
FIG. 11 is a front elevation view of the APC.
Figure 13:
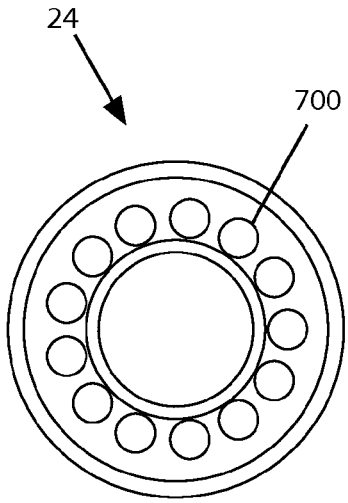
FIG. 13 is a top plan view of the APC.
Figure 12:
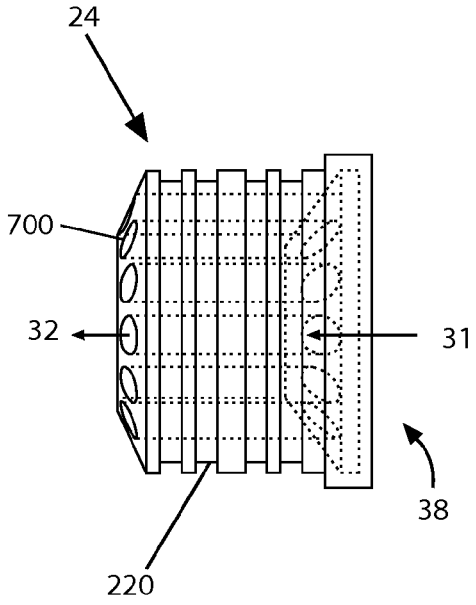
FIG. 12 is a sectional view of the APC.

FIGS. 11, 12, 13 show details of the APC 24 having grooves 220 for bushings 22. Thirteen elongated bore holes 700 allow a high flow rate of inhalation air.

Figure 14:
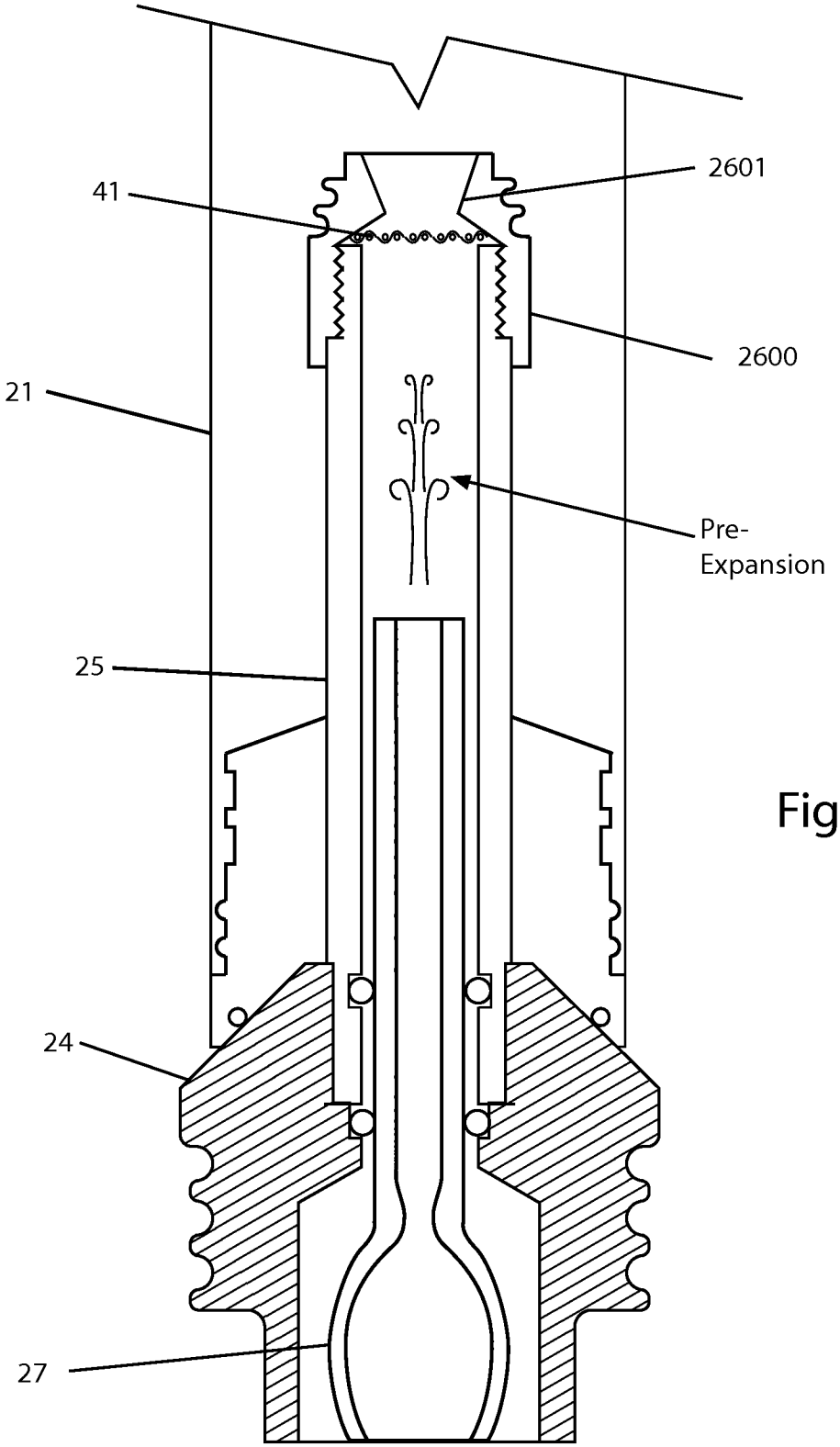
FIG. 14 is a longitudinal sectional view of a pipe having an alternate smoke injection nozzle.
Figure 15:
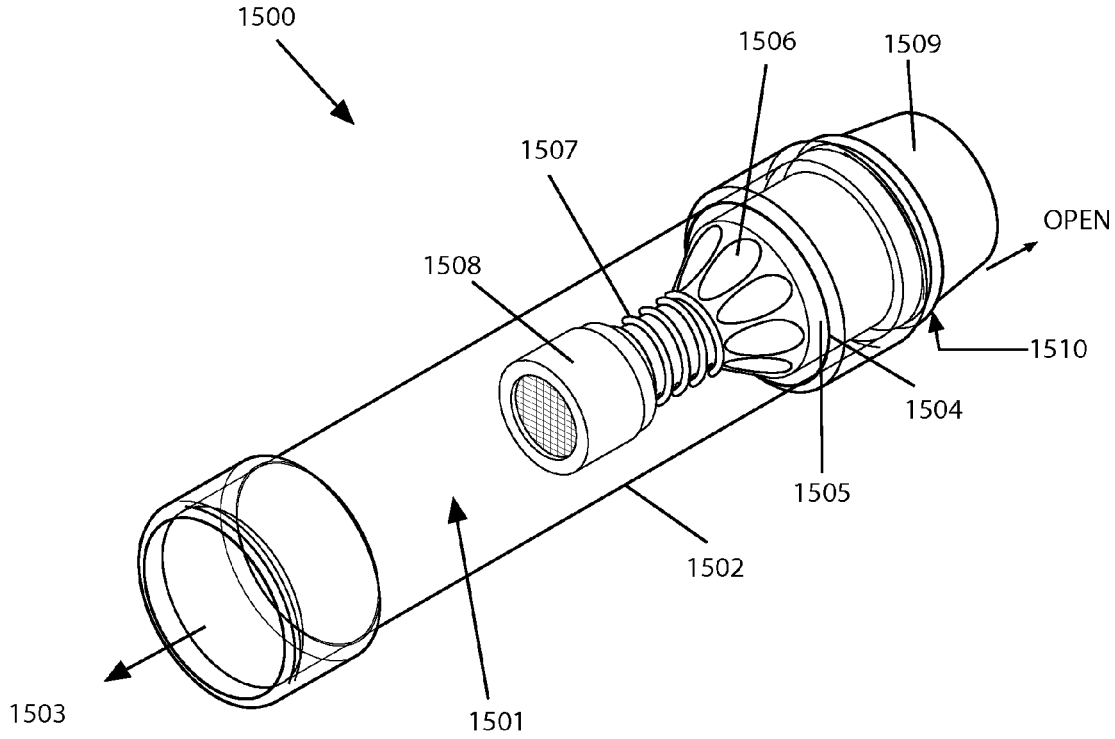
FIG. 15 is a top perspective view of a pocket sized embodiment.
Figure 16:
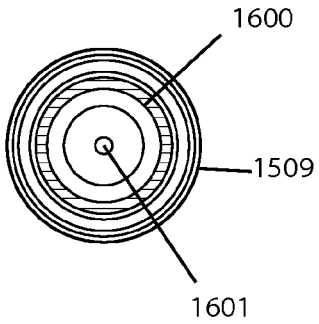
FIG. 16 is a front elevation view of the FIG. 15 embodiment.
Figure 17:
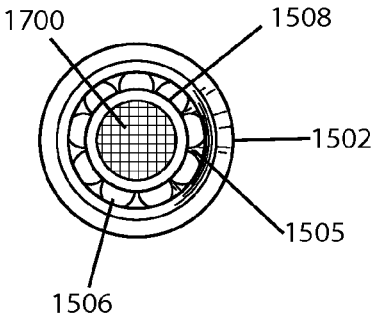
FIG. 17 is a rear elevation view of the FIG. 15 embodiment.
Figure 18:
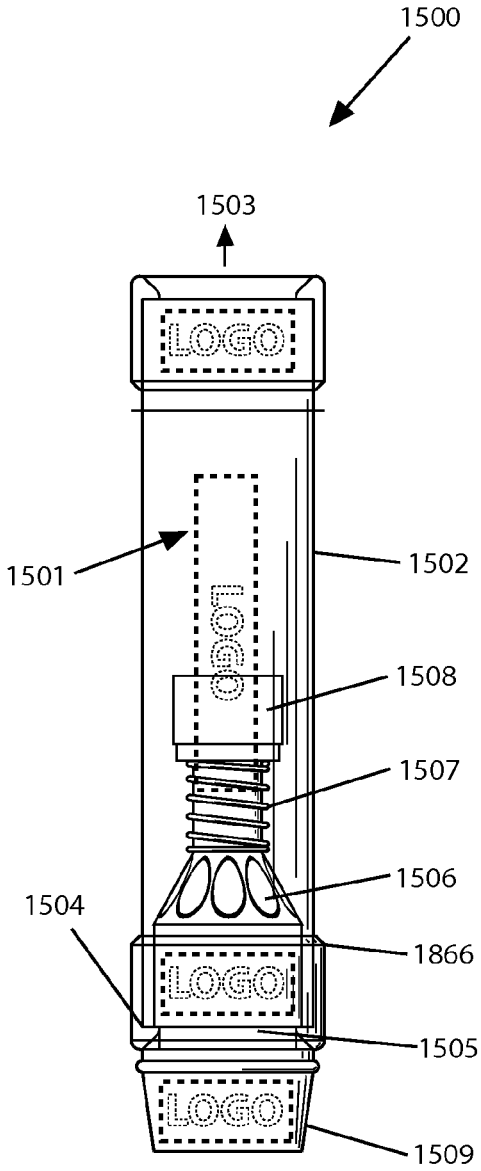
FIG. 18 is a side elevation view of the FIG. 15 embodiment.

FIG. 14 shows a modified smoke nozzle 2600 having a flared exit port 2601 for smoother output smoke A flow.

Referring next to FIGS. 15-20 a pocket sized pipe 1500 works the same as pipe 20 of FIG. 2. The smoke expansion chamber 1501 is enclosed by a (transparent) plastic cylinder 1502 which has an inhalation port 1503. A retension band 1866 holds the distal end of the plastic cylinder 1502 in place over the APC.

The APC 1505 has nine bore holes 1506. The valve head spring 1507 seats on nozzle 1508. The user pulls the valve head 1509 in the OPEN direction for inhalation, allowing ambient air to enter annular passage 1510 and flow through bore holes 1506 into expansion chamber 1501. A glass burn bowl 1600 has an inside chamber 1601 about 7/16 inches in diameter. Nozzle 1508 has filter screen 1700.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A pipe comprising:

an elongate chamber having an inhalation port at a proximal end suited to fit over a user's mouth;

a smoke expansion chamber extending away from the inhalation port;

a purge carburetor extending from a distal end of the elongate chamber;

said purge carburetor having an extendable valve head that seals an annular inlet in a passive mode and opens the annular inlet in an inhalation mode;

a smoke injection shaft affixed to the extendable valve head;

said annular inlet further comprising a plurality of elongate bores arranged in a circular pattern around the smoke injection shaft, said extendable valve head having a burn bowl feeding into the smoke injection shaft that protrudes into the smoke expansion chamber;

wherein burning a material in the burn bowl while the user provides inhalation pressure over the inhalation port in the passive mode injects smoke from the burn bowl through the smoke injection shaft and into the smoke expansion chamber;

wherein extending the extendable valve head along with the smoke injection shaft, for the inhalation mode opens the annular inlet allowing ambient air to rush into the smoke expansion chamber and force the smoke into the user's mouth; and wherein a spring biases the extendable valve head back to the passive mode.

2. The pipe of claim 1, wherein the elongate chamber has a cylindrical shape and is made of a transparent material.

3. The pipe of claim 2, wherein the purge carburetor comprises an assembly including the smoke injection shaft, an annular mounting collar around the smoke injection shaft which removably engages the distal end of the elongate chamber, and a spring loaded extendable valve head.

4. The pipe of claim 3, wherein the burn bowl further comprises a glass bowl having a stem removably insertable into the extendable valve head and shock mounted inside the valve head.

5. The pipe of claim 4, wherein the purge carburetor further comprises an annular shape having an annular bushing around the annular mounting collar to engage an interior annular wall of the elongate chamber.

6. The pipe of claim 5, wherein the smoke injection shaft further comprises a removable nozzle having a screen filter therein.

7. A pipe comprising:

an elongate chamber having an inhalation port at a proximal end suited to fit over a user's mouth;

a smoke expansion chamber extending away from the inhalation port;

a purge carburetor extending from a distal end of the elongate chamber;

said purge carburetor having an extendable valve head that seals an annular inlet in a passive mode and opens the annular inlet in an inhalation mode;

said extendable valve head having a burn bowl feeding into a smoke injection shaft that protrudes into the smoke expansion chamber;

wherein burning a material in the burn bowl while the user provides inhalation pressure over the inhalation port in the passive mode injects smoke from the burn bowl through the smoke injection shaft and into the smoke expansion chamber;

wherein extending the extendable valve head for the inhalation mode opens the annular inlet allowing ambient air to rush into the smoke expansion chamber and force the smoke into the user's mouth;

wherein the elongate chamber has a cylindrical shape and is made of a transparent material;

wherein the purge carburetor comprises an assembly including the smoke injection shaft, an annular mounting collar around the smoke injection shaft which removably engages the distal end of the elongate chamber, and a spring loaded extendable valve head; and wherein the spring loaded extendable valve head further comprises a bushing on the smoke injection shaft that secures a cylindrical spring around the smoke injection shaft.

8. A pipe comprising:

an elongate chamber having an inhalation port for a user's mouth;

a smoke expansion chamber attached to the inhalation port;

a purge carburetor extending from an orifice of the elongate chamber;

said purge carburetor having a plurality of bores arranged in a circular pattern around a smoke injection shaft;

said purge carburetor having an extendable valve head that seals the bores which are in fluid communication with the smoke expansion chamber in a passive mode and opens the bores to outside air in an inhalation mode;

said extendable valve head having a burn bowl feeding into the smoke expansion chamber;

wherein burning a material in the burn bowl while the user provides inhalation pressure over the inhalation port in the passive mode injects smoke from the burn bowl into the smoke expansion chamber;

wherein extending the extendable valve head for the inhalation mode opens the inlet allowing ambient air to rush into the smoke expansion chamber and force the smoke into the user's mouth; and wherein the purge carburetor comprises an assembly including a smoke injection shaft in fluid communication with the burn bowl, a mounting collar around the smoke injection shaft which engages the inlet to the smoke expansion chamber, and a spring loaded extendable valve head which biases the purge carburetor closed in a passive mode.

9. The pipe of claim 8, wherein the elongate chamber has a cylindrical shape and is made of a transparent material.

10. The pipe of claim 9, wherein the burn bowl further comprises a stem removably insertable into the extendable valve head.

11. The pipe of claim 9, wherein the inlet to the smoke expansion chamber further comprises a plurality of bore holes.

12. The pipe of claim 9, wherein the smoke injection shaft further comprises a filter.

13. A pipe comprising:

an elongate chamber having an inhalation port for a user's mouth;

a smoke expansion chamber attached to the inhalation port;

a purge carburetor spring loaded to open and close an orifice of the elongate chamber; said purge carburetor having an extendable valve head that seals a plurality of bores arranged in a circular pattern around a smoke injection shaft, said plurality of bores forming an inlet to the smoke expansion chamber in a passive mode and opens the inlet in an inhalation mode;

said valve head having a burn bowl feeding into the smoke expansion chamber;

wherein burning a material in the burn bowl while the user provides inhalation pressure over the inhalation port in the passive mode injects smoke from the burn bowl into the smoke expansion chamber; and wherein opening the valve head for the inhalation mode opens the inlet allowing ambient air to rush into the smoke expansion chamber in parallel columns of air and forces the smoke into the user's mouth.

14. The pipe of claim 13, wherein the elongate chamber has a cylindrical shape and is made of a transparent material.

15. The pipe of claim 14, wherein the purge carburetor comprises an assembly including a smoke injection shaft in fluid communication with the burn bowl, and a mounting collar around the smoke injection shaft which engages the inlet to the smoke expansion chamber.

16. The pipe of claim 15, wherein the inlet is located at a distal end of a cylindrical smoke expansion chamber.

* * * * *